US008567142B2

(12) United States Patent
Swartz

(10) Patent No.: US 8,567,142 B2
(45) Date of Patent: Oct. 29, 2013

(54) MOUNTING FIXTURE FOR FIRE-RATED STRUCTURALLY GLAZED GLASS

(76) Inventor: Dustin D. Swartz, Bothell, WA (US)

( * ) Notice: Subject to any disclaimer, the term of this patent is extended or adjusted under 35 U.S.C. 154(b) by 1 day.

(21) Appl. No.: 13/375,192

(22) PCT Filed: May 6, 2011

(86) PCT No.: PCT/US2011/035619

§ 371 (c)(1),
(2), (4) Date: Nov. 29, 2011

(87) PCT Pub. No.: WO2011/140500

PCT Pub. Date: Nov. 10, 2011

(65) Prior Publication Data

US 2012/0066991 A1 Mar. 22, 2012

Related U.S. Application Data

(60) Provisional application No. 61/332,574, filed on May 7, 2010.

(51) Int. Cl.
*E04H 6/00* (2006.01)

(52) U.S. Cl.
USPC ..... 52/235; 52/745.12; 52/209

(58) Field of Classification Search
USPC ..... 52/235, 745.12, 745.1, 745.06, 209, 52/204.593, 656.5
See application file for complete search history.

(56) References Cited

U.S. PATENT DOCUMENTS

| | | | | |
|---|---|---|---|---|
| 4,449,341 | A | 5/1984 | Taglianetti et al. | |
| 4,552,790 | A | 11/1985 | Francis | |
| 4,912,898 | A | 4/1990 | Holmes | |
| 4,961,975 | A | 10/1990 | Bejnar | |
| 5,802,799 | A * | 9/1998 | Thuleskar et al. | 52/656.5 |
| 6,401,410 | B2 | 6/2002 | Kenny et al. | |
| 7,922,224 | B2 * | 4/2011 | Arias | 292/302 |
| 2010/0011687 | A1 | 1/2010 | Arias | |

FOREIGN PATENT DOCUMENTS

| | | |
|---|---|---|
| DE | 10214664 | 7/2003 |
| EP | 1936096 | 6/2008 |

OTHER PUBLICATIONS

International Search Report from International PCT Application No. PCT/US2011/035619, dated Aug. 4, 2011.
Written Opinion of the International Search Report from International PCT Application No. PCT/US2011/035619, dated Aug. 4, 2011.

* cited by examiner

*Primary Examiner* — Jeanette E Chapman
*Assistant Examiner* — Daniel Kenny
(74) *Attorney, Agent, or Firm* — Klarquist Sparkman, LLP

(57) ABSTRACT

The system includes a concealed, glazing retention method and system for use with a fire rated structurally glazed curtain wall. In one embodiment, a pressure plate is configured to be coupled to a building structure and positionable between an outer face of the fire rated glazing unit and an inner face of the glass unit. A plurality of retaining members can secure the pressure plate to the building structure.

18 Claims, 14 Drawing Sheets

FIG. 3A
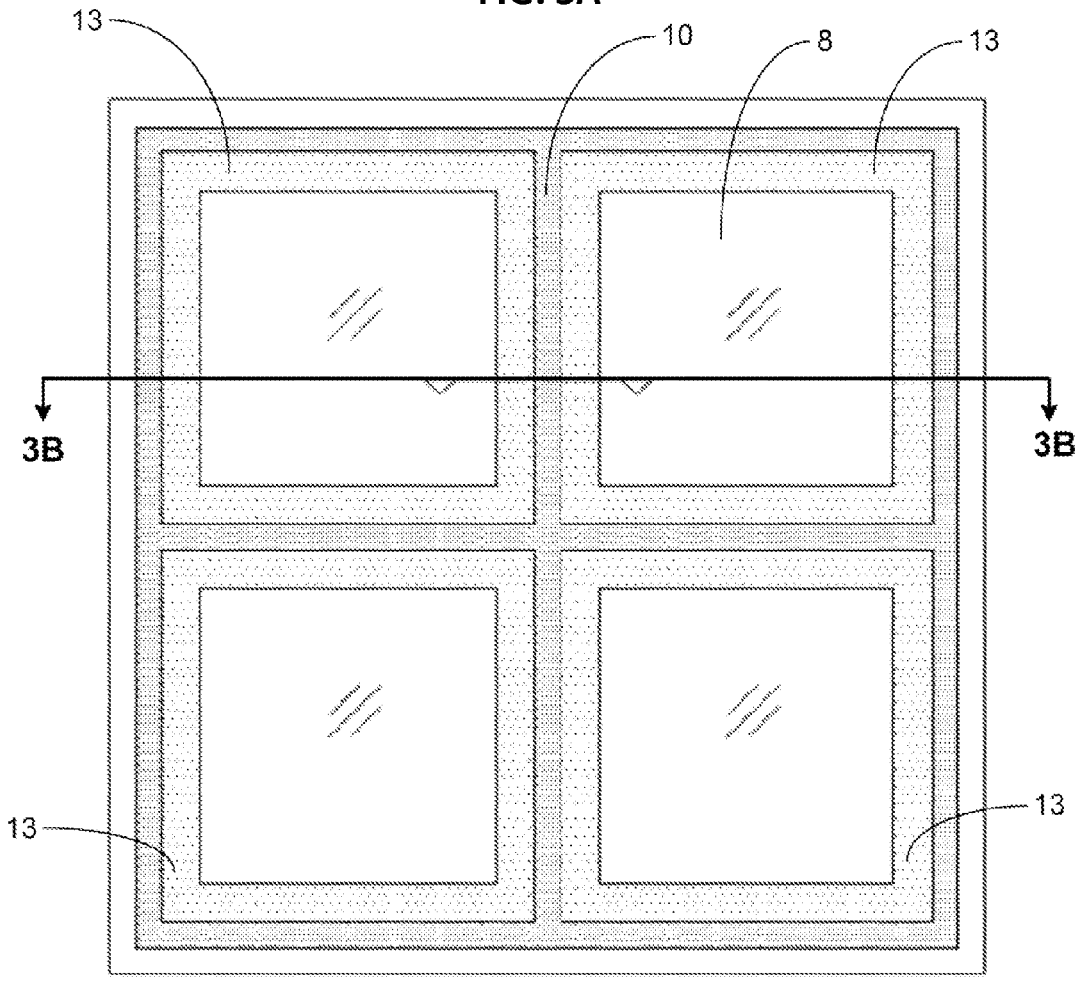
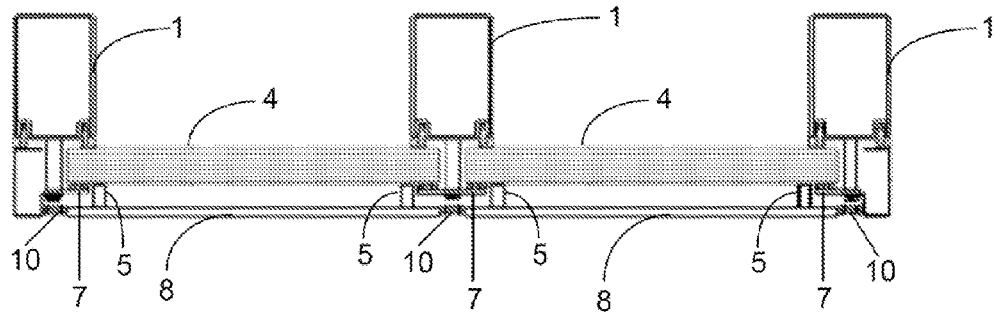
FIG. 3B

MOUNTING FIXTURE FOR FIRE-RATED STRUCTURALLY GLAZED GLASS

CROSS-REFERENCE TO RELATED APPLICATIONS

This is the U.S. National Stage of International Application No. PCT/US2011/035619, filed May 6, 2011, which was published in English under PCT Article 21(2), which in turn claims the benefit of U.S. Provisional Application No. 61/332,574, filed May 7, 2010. The entire disclosures of the prior applications are incorporated herein in their entirety.

FIELD

This application relates to window construction, and in particular to an assembly construction made from fire rated glass and a fire rated surrounding framing system.

BACKGROUND

Architects and the public at large appreciate the aesthetics of glass and other light transmitting materials used in the built environment. Light transmitting materials that serve both an aesthetic function as well as a structural function are appreciated for their economy and visual effects. A common means prescribed by architects to achieve these goals in building structures is through the use of glass "curtain wall" systems.

Conventional curtain walls cover an outer surface of a building in a non-structural manner. The non-structural curtain wall is usually made of lightweight material to reduce loads and construction costs. Conventional curtain walls are often designed with extruded aluminum members and the aluminum members are infilled with glass or other members. Glass curtain walls can be advantageous since they allow natural light to penetrate into the building. The curtain wall structure usually will not bear any load from the building except for the weight of the curtain wall itself, and the wall transfers wind loads incident upon the curtain wall surface to the main building structure through connections at floors or columns of the building.

Aesthetic design and performance levels of curtain walls can be extremely varied. Frame system widths, depths, anchoring methods, and accessories have grown diverse due to industry and design innovation. Two common categories are "pressure wall" and "structurally glazed" systems. A pressure wall system utilizes an exposed pressure plate to retain the glass on the face of the supporting frame, whereas a structurally glazed design has no such exposed fastener.

Although some glass and frame technologies have been developed that are capable of passing applicable fire test and building code requirements, no such system has been developed for structurally glazed curtain wall systems, which have no exposed pressure plates or fasteners that retain the exterior glass. Accordingly, there is a need for a structurally glazed system that is capable of meeting or exceeding existing fire test and building code requirements.

SUMMARY

In one embodiment, a fire rated curtain wall system is provided. The system includes a unique and novel, concealed, glazing retention method, so as to eliminate visible protruding glass retention components.

In another embodiment, a fire rated, capless, glass wall system is provided that is capable of meeting fire barrier and thermal transfer limitations as per ASTM E119 or comparable test standard for a duration of at least 45 minutes, including the required hose stream test. In other embodiments, the system is capable of meeting fire barrier and thermal transfer limitations as per ASTM E119 or comparable test standard for a duration of at least 60, 90, and/or 120 minutes.

In one embodiment, a structurally glazed curtain wall system is provided. The system includes a first insulated glazing unit comprising a fire rated glazing unit spaced apart and coupled to a glass unit. A first pressure plate can be configured to be coupled to a building structure and positionable between an outer face of the fire rated glazing unit and an inner face of the glass unit. A plurality of retaining members can secure the first pressure plate to the building structure.

In other implementations, the fire rated glazing unit and glass unit can be coupled together by at least one spacer. A first face of the spacer can be adhered to an outside surface of the fire rated glazing unit and a second face of the spacer can be adhered to an inside surface of the glass unit. A second insulated glazing unit and a second pressure plate can couple the second insulated glazing unit to the same building structure. The building structure to which the pressure plates are coupled can be a steel mullion.

In other implementations, the first pressure plate and the second pressure plate can be interleaved. Each of the first pressure plate and the second pressure plate comprises extending members that have openings for receiving the retaining members, and the extending members of the first pressure plate and the extending members of the second pressure plate vertically overlap. A plurality of threaded stand-off spacers can be positioned between one extending member of either the first or second pressure plate and configured to receive one retaining member to couple the first or second pressure plate to the building structure. In other embodiments, a glazing gasket can be positioned between each extending member and the outside surface of the fire rated glazing of the first and second insulated glazing units. A silicone weather seal can also be positioned between the first insulated glazing unit and the second insulated glazing unit. In some embodiments, the insulated glazing unit meets fire barrier and thermal transfer limitations as per ASTM E119 for a period duration of at least 45 minutes. In other embodiments, the insulated glazing unit meets fire barrier and thermal transfer limitations as per ASTM E119 for a period duration of at least 60, 90, and/or 120 minutes.

In another embodiment, a method of constructing a structurally glazed curtain wall is provided. The method includes providing a first insulated glazing unit with a fire rated glazing unit coupled to a glass unit and positioning a first pressure plate at least partially between the fire rated glazing unit and the glass unit. The fire rated glazing unit and glass unit are coupled together with a plurality of spacers. The first insulated glazing unit is coupled to a building structure by securing a plurality of retaining members to the pressure plate and the building structure. The pressure plate secures the first insulated glazing unit to the building structure by applying a pressure against an outer face of the fire rated glazing unit.

In other embodiments, the coupling of the first glazing unit to the building unit comprises securing a screw through the pressure plate and into a threaded stand-off spacer positioned between the building structure and the pressure plate. A second insulated glazing unit with a fire rated glazing unit coupled to a glass unit can be provided. The fire rated glazing unit and glass unit can be coupled together with a plurality of spacers. A second pressure plate can be positioned at least partially between the fire rated glazing unit and the glass unit of the second insulated glazing unit. The second insulated glazing unit can be coupled to the building structure by securing a plurality of retaining members to the second pressure plate and the building structure. The first and second pressure plates can be at least partially interleaved. In some embodiments, the first and second pressure plates comprise extending sections that vertically overlap one another. A weather seal can be secured between the first and second insulated glazing units.

In other embodiments, the pressure plates comprise a plurality of rotatable retainer plates. The rotatable retainer plates can be toggle retainers that are sized to be received within one of a plurality of slots positioned adjacent the outer face of the fire rated glazing unit. Each slot (e.g., formed in a slotted spacer member) can receive a toggle retainer to secure the fire rated glazing to the building structure.

The foregoing and other objects, features, and advantages of the disclosed embodiments will become more apparent from the following detailed description, which proceeds with reference to the accompanying figures.

BRIEF DESCRIPTION OF THE DRAWINGS

FIG. 3A is a front view of a system for constructing a structurally glazed curtain wall with an internally concealed connection to a building member, such as a frame member (e.g., a mullion frame member of steel or other materials), shown with four insulated glazing units coupled to the building.

FIG. 3B is a cross-sectional view taken along line 3B-3B of FIG. 3A.

DETAILED DESCRIPTION

Figure 1:
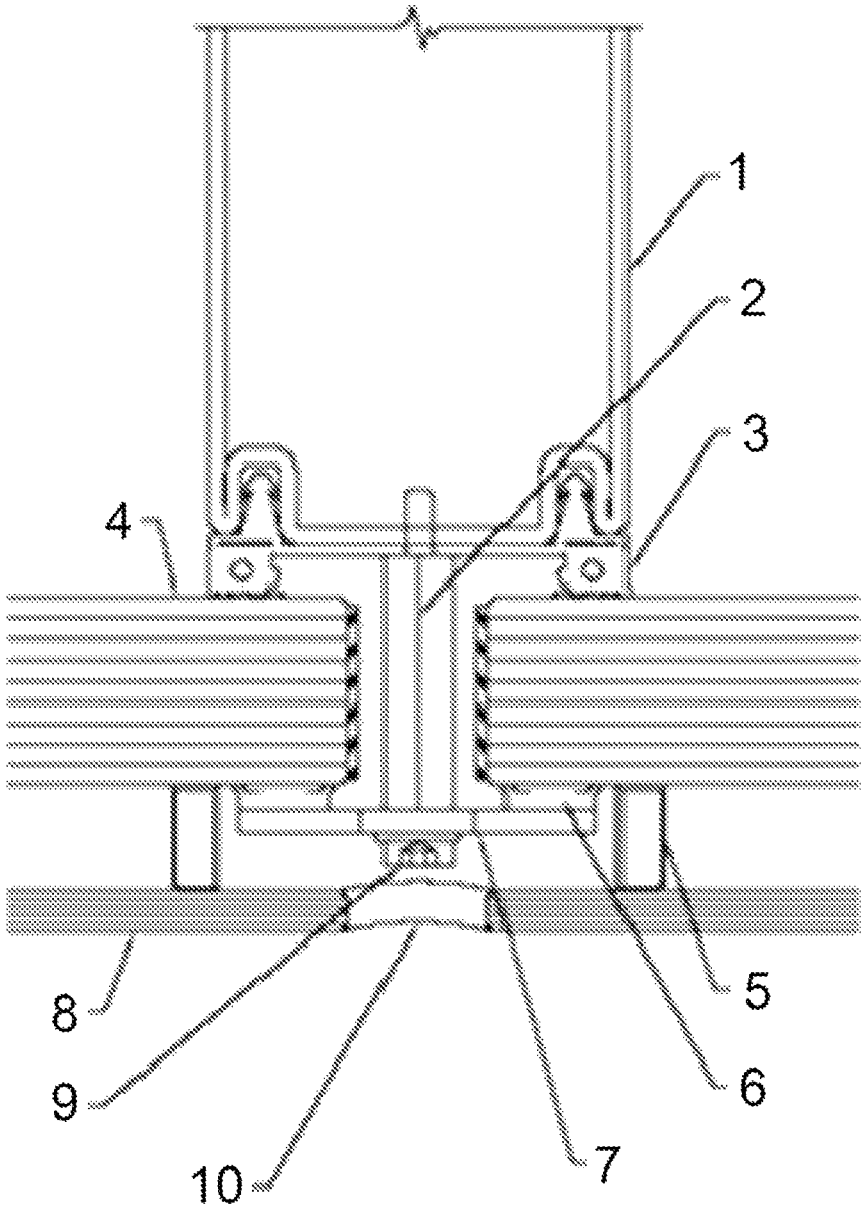
FIG. 1 is a top view of a system for constructing a structurally glazed curtain wall with an internally concealed connection to a building member, such as a steel mullion.

The following description is exemplary in nature and is not intended to limit the scope, applicability, or configuration of the invention in any way. Various changes to the described embodiment may be made in the function and arrangement of the elements described herein without departing from the scope of the invention.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways in which the disclosed system, method, and apparatus can be used in combination with other systems, methods, and apparatuses. However, those ways are readily discernable, based on this disclosure, by one of ordinary skill in the art. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

The use of curtain wall and building design requirements are governed by applicable building codes. In the U.S., this generally means following the International Building Code (IBC) requirements as developed by the International Code Council (ICC). The IBC defines the parameters for building design by addressing items such as "General Building Height and Area Limitations," "Structural Design," "Means of Egress," and "Fire Resistance Rated Construction."

Chapter 7 of the International Building Code govern the materials and assemblies used for structural fire resistance and fire resistance rated construction to safeguard against the spread of fire within a building, or from one building to another. This chapter specifies the various types of fire rated construction required for different building types, in addition to what design allowances are provided for those fire rated areas. Further, the chapter prescribes what standardized tests materials must pass to be classified as "fire rated," and therefore allowable for use in such areas as dictated by Code.

For fire resistance rated construction, these test standards commonly require the applicable building material to withstand fire exposure for a specified amount of time. This can include the resistance to passage of flame, smoke, and radiant and conductive heat from twenty minutes to several hours. In addition, these test standards commonly require the assembly be impacted by water sprayed from a two-man fire hose immediately after exposure to the fire. Such exposure is intended to provide a means of testing the materials resistance to the impact, erosion, and cooling effects of the water; and eliminates inadequate materials or constructions. The inability to pass such test standards generally prohibits their use in building areas required by the IBC to utilize fire rated materials.

Traditional curtain wall materials (e.g., those that include conventional glass, framing members, anchoring systems, and other accessories) are unable to pass the fire test standards described above, and therefore may not be considered as fire rated construction. The inability of typical curtain wall construction to meet these standards is due to numerous reasons. For example:

1. Framing members and window glass cannot withstand the high temperatures and pressures created by the fire tests.

2. Framing members and window glass cannot withstand the impact, erosion and cooling (thermal shock) of the mandatory 'fire hose stream test' prescribed in standards.

3. Framing members and window glass cannot provide the barrier to radiant and conductive heat transfer prescribed in standards.

Although some glass and frame technologies have been developed that are capable of passing applicable fire test and building code requirements, no such system has been developed for structurally glazed curtain wall systems. The following embodiments illustrate structurally glazed curtain wall systems that meet applicable building code, including requirements for classification as a fire rated assembly.

FIG. 1 illustrates a structurally glazed curtain wall system that includes fire rated glazing. The fire rated glazing 4 is coupled to an outside pane of window glass 8 via a plurality of elongated metallic spacers 5 to form an insulated glazing unit (IGU). Thus, an IGU comprises a fire rated glazing 4, a glass 8, a plurality of spacers 5 extending between the glazing 4 and glass 8, and the air trapped between the fire rated glazing 4 and glass 8. Spacers 5 can be permanently attached or coupled to the fire rated glazing 4 and the glass 8. For example, an adhesive sealant, such as polyisobutylene (PIB), can be applied to both faces of spacer 5 (i.e., the face that faces the fire rated glazing 4 and the face that faces the glass 8) and the fire rated glazing 4 and glass 8 can be pressed against the respective faces of the spacer 5 until the desired adhesion is produced.

The IGU can be coupled to the building using a concealed (internal) pressure plate system. In particular, the IGU can be coupled to the building (e.g., to a steel mullion 1 coupled to the building structure) via an internal pressure plate 7 that is positioned inside of the vertical surface defined by the glass 8 and within a space between the glass 8 and the glazing 4. The internal space between the glass 8 and the glazing 4 is created by the use of spacers 5 (FIG. 1). By positioning the pressure plates 7 inside of the glass 8, the pressure plates 7 can be concealed from view from a location outside of the building.

Figure 2:
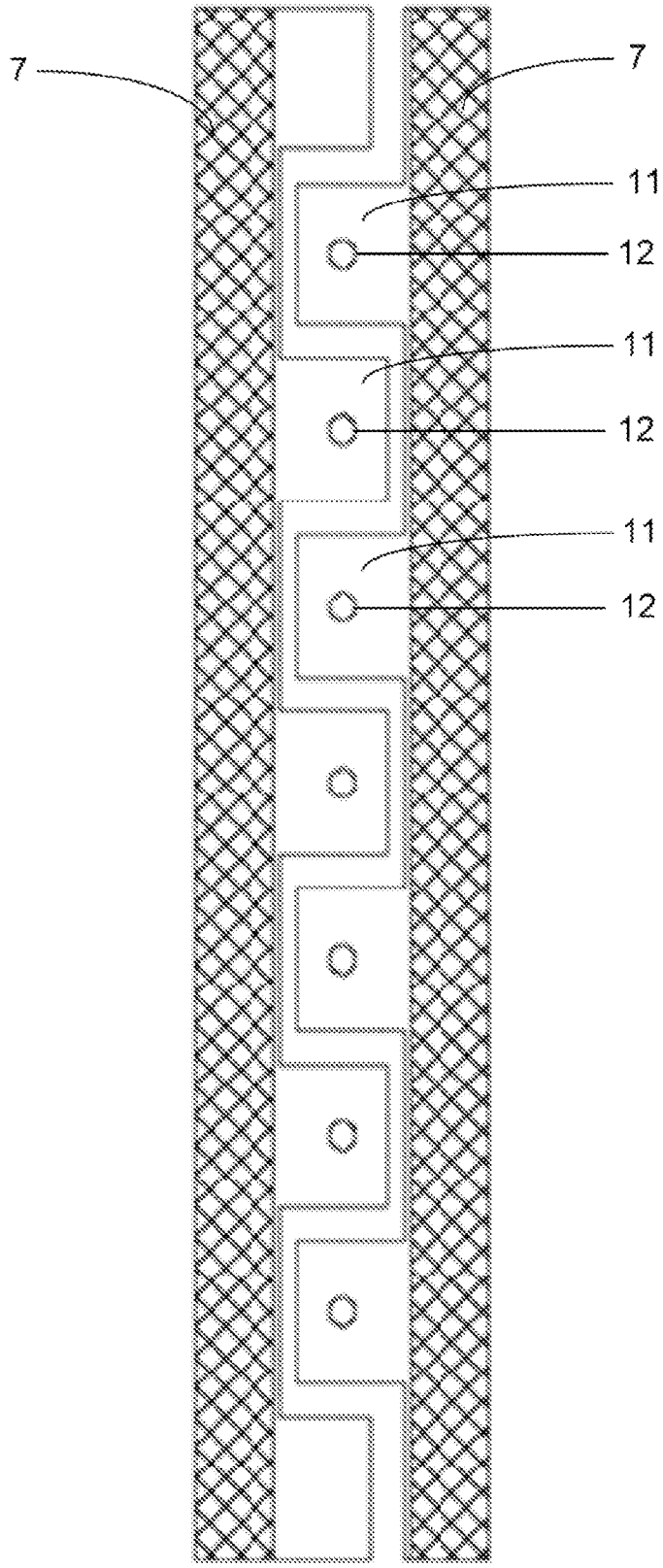
FIG. 2 is a front view of an interleaved pressure plate structure as shown in FIG. 1.

The internal pressure plates 7 can be secured to the building (e.g., to steel mullion 1) using retaining members 9 (e.g., screws) that pass through a plurality of threaded stand-off spacers 2. The threaded stand-off spacers 2 can be placed at intervals around the glass perimeter and positioned to coincide with mating holes 12 in the pressure plates 7 (FIG. 2). To produce a sufficient amount of pressure on the fire rated glazing 4 of the IGU to support the weight of the IGU unit, a plurality of retaining members 9 are threaded through the holes 12 of the pressure plates 7 and into the threaded stand-off to secure the pressure plates 7 to the steel mullion 1.

Figure 4:
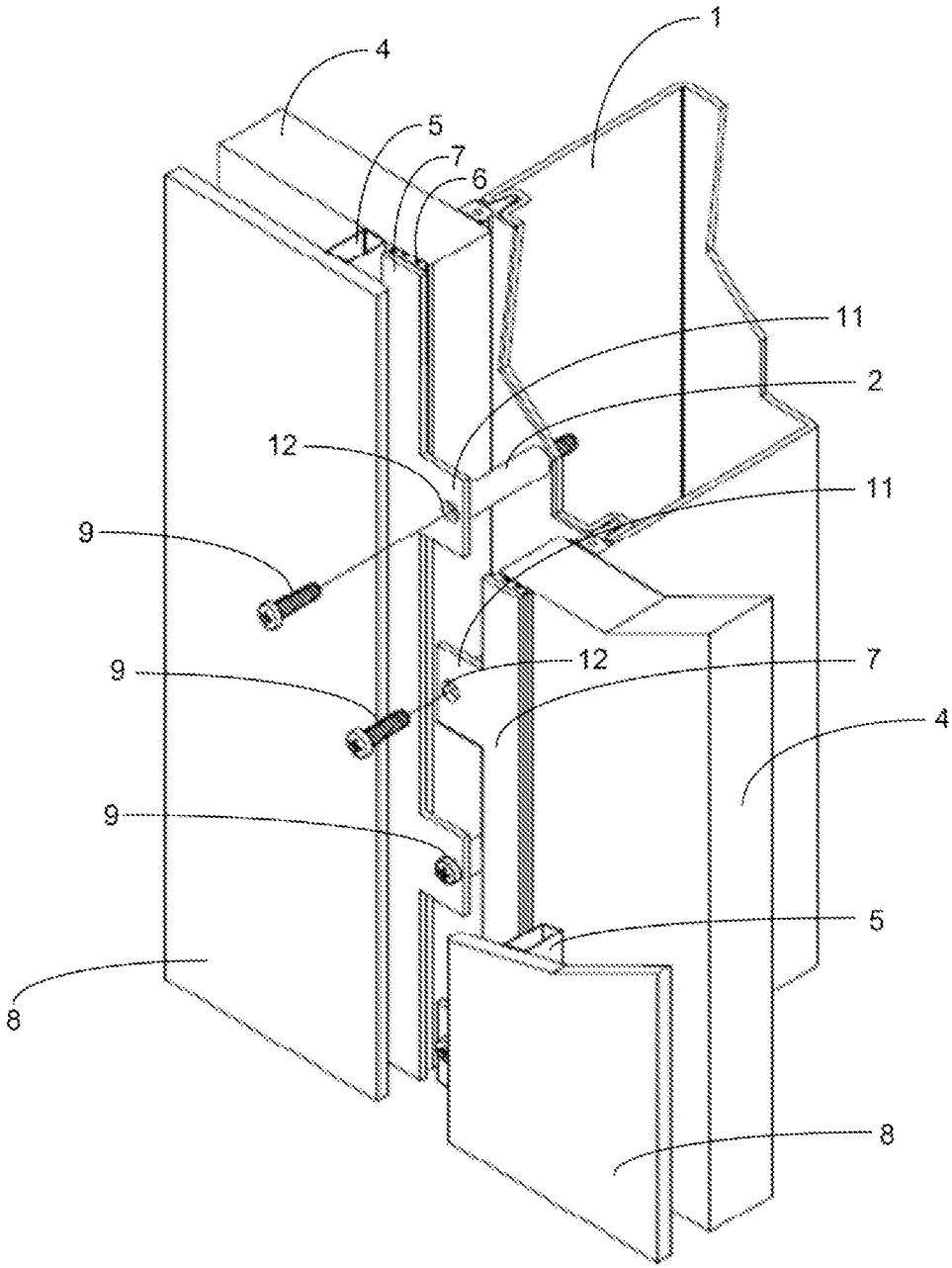
FIG. 4 is an enlarged perspective view of a system for connecting an insulated glazing unit to a building member, such as a steel mullion.

FIG. 4 illustrates a perspective enlarged view of an illustrated mechanism for coupling pressure plates 7 to the fire rated glazing 4 of each IGU. Portions of the glass 8 and fire rated glazing 4 of the IGU shown on the right side of FIG. 4 are partially cut away to better illustrate the location of the spacers 5 and the threaded stand-off spacers 2.

As shown in FIGS. 2, 3A, and 3B, pressure plates 7 can be positioned around the entire periphery of the IGU or around only a portion thereof. Although the several views illustrate pressure plates 7 in a vertical orientation, it should be understood that the pressure plates 7 can be oriented horizontally as well in the same general manner. FIG. 2 illustrates a front view of a pair of internal pressure plates 7. Each pressure plate 7 is configured to apply a pressure to a fire rated glazing 4 and has an extending portion 11 that extends laterally away from the fire rated glazing 4 for securement to the steel mullion 1. The extending portions 11 can be provided with openings 12 for receiving the retaining members 9 (e.g., screws) as shown in FIG. 4. The interleaved or overlapping design of the pressure plates 7 allows for easier insertion of the pressure plates into the restricted area between the multiple IGUs.

Referring again to FIG. 1, a glazing gasket 6 can be provided between pressure plates 7 and the fire rated glazing 4. Gaskets 6 can ensure that pressure plates 7 apply a uniform interface pressure to the IGU. In addition, weather sealing can accomplished via inside gasket 3 and silicone weather seal 10. Thus, inside gaskets can be positioned between the fire rated glazing 4 and the steel mullion 1 to reduce moisture build-up within the IGU from inside the building, and silicone weather seals 10 can restrict moisture or other elements from entering or penetrating the IGU from outside the building.

FIG. 3A is a schematic front view of a structurally glazed system as disclosed herein, illustrating a structurally glazed curtain wall system that comprises four IGUs along a wall. FIG. 3B is a sectional view taken along line 3B-3B of FIG. 3A. As shown in FIGS. 3A and 3B, each of the IGUs is surrounded by weather seals 10. If desired, opaque or tinted sections 13 of glass 8 can be provided to further hide or at least partially obscure the pressure plates 7 of the structural glazed system from view.

Figure 5:
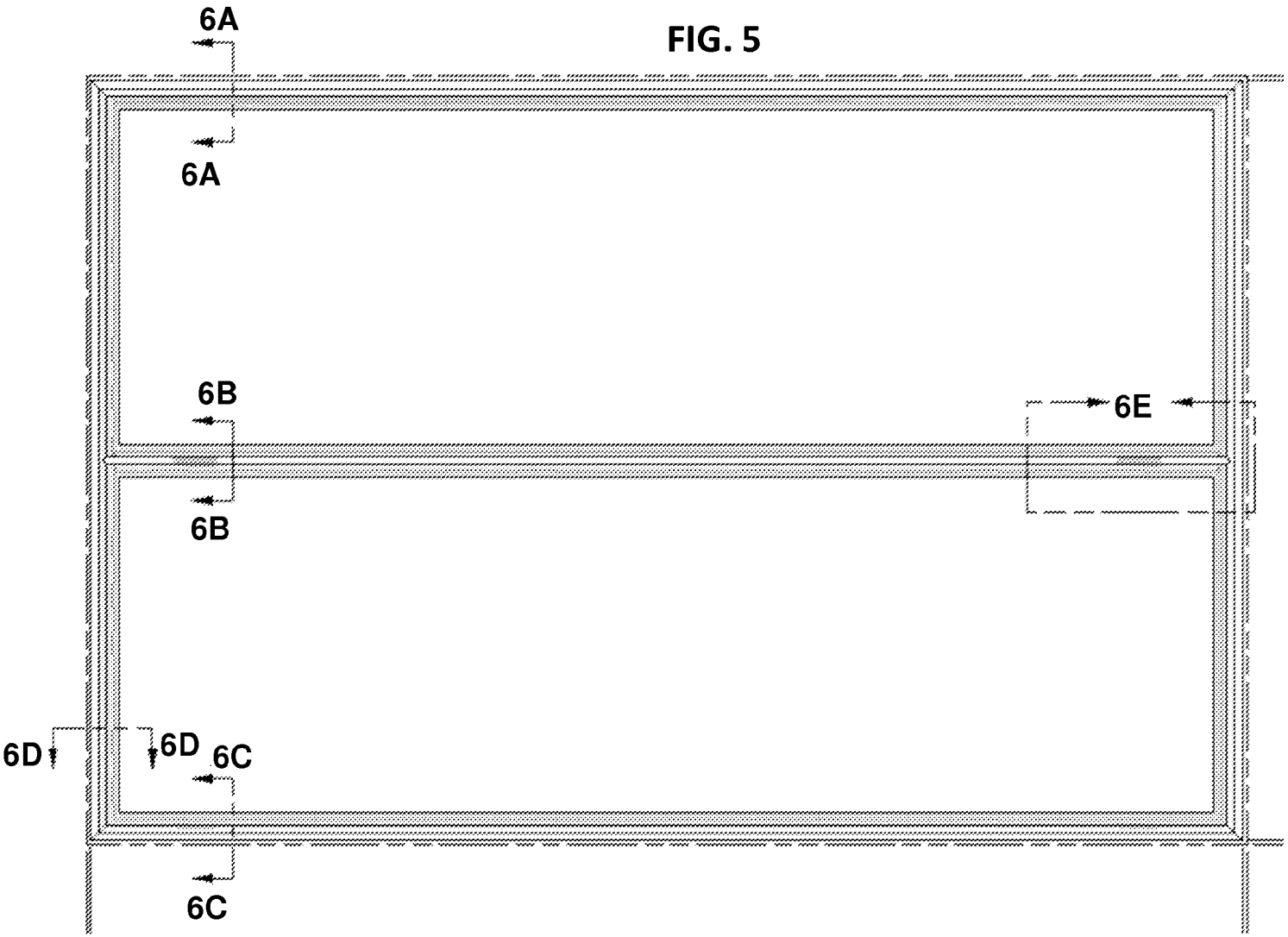
FIG. 5 is a front view of a system for constructing a structurally glazed curtain wall with an internally concealed connection to a building member, such as a steel mullion.

FIG. 5 illustrates another schematic front view of a structurally glazed system and FIGS. 6A-6E illustrate various cross-sectional and partial cross-sectional views taken from points along the structurally glazed system shown in FIG. 5. For convenience, when describing similar elements in different embodiments similar numbering may be used.

As shown in FIGS. 6A-6D, and as described elsewhere herein, internal pressure plates 107 can be secured to the building (e.g., to a steel mullion frame member 101) using retaining members that pass through a plurality of threaded stand-off spacers 102. The threaded stand-off spacers 102 can be placed at intervals around the glass perimeter and positioned to coincide with mating holes in the pressure plates 107 (e.g., FIG. 2).

The fire rated glazing 104 can be coupled to an outside pane of window glass 108 via a plurality of elongated metallic spacers 105 to form an insulated glazing unit (IGU). Thus, an IGU comprises a fire rated glazing 104, a glass 108, a plurality of spacers 105 extending between the glazing 104 and glass 108, and the air trapped between the fire rated glazing 104 and glass 108. As described elsewhere, spacers 105 can be permanently attached or coupled to the fire rated glazing 104 and the glass 108. For example, an adhesive sealant, such as polyisobutylene (PIB), can be applied to both faces of spacer 105 (i.e., the face that faces the fire rated glazing 104 and the face that faces the glass 108) and the fire rated glazing 104 and glass 108 can be pressed against the respective faces of the spacer 105 until the desired adhesion is produced.

As described elsewhere, a glazing gasket 106 can be provided between pressure plates 107 and the fire rated glazing 104. Gaskets 106 can ensure that pressure plates 107 apply a uniform interface pressure to the IGU. In addition, weather sealing can accomplished via inside gasket 103 (e.g., an extruded gasket) and silicone weather seal 110. Thus, inside gaskets can be positioned between the fire rated glazing 104 and the steel mullion frame member 101 to reduce moisture build-up within the IGU from inside the building, and silicone weather seals 110 can restrict moisture or other elements from entering or penetrating the IGU from outside the building. If desired, a backer support 120 for the silicone weather seal 110 can be provided to support the weather seal 110. As shown in FIGS. 6A-6D, additional silicone seals can be provided between glass 108 and glazing 104 as desired.

Figure 6B:
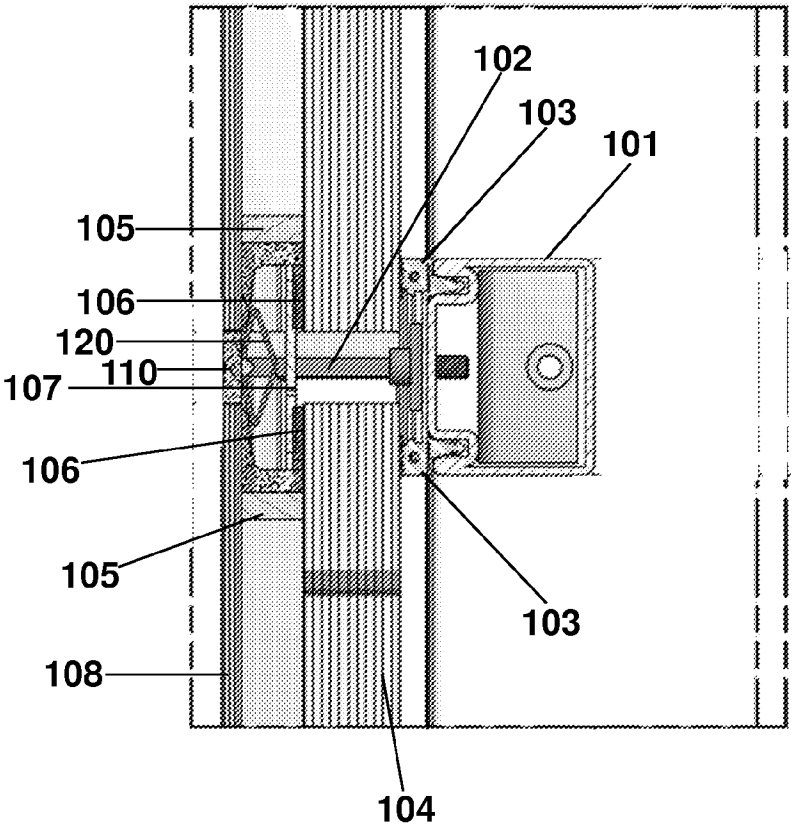
FIG. 6B is a cross-sectional view of the structurally glazed curtain wall taken along line 6B-6B in FIG. 5.
Figure 6A:
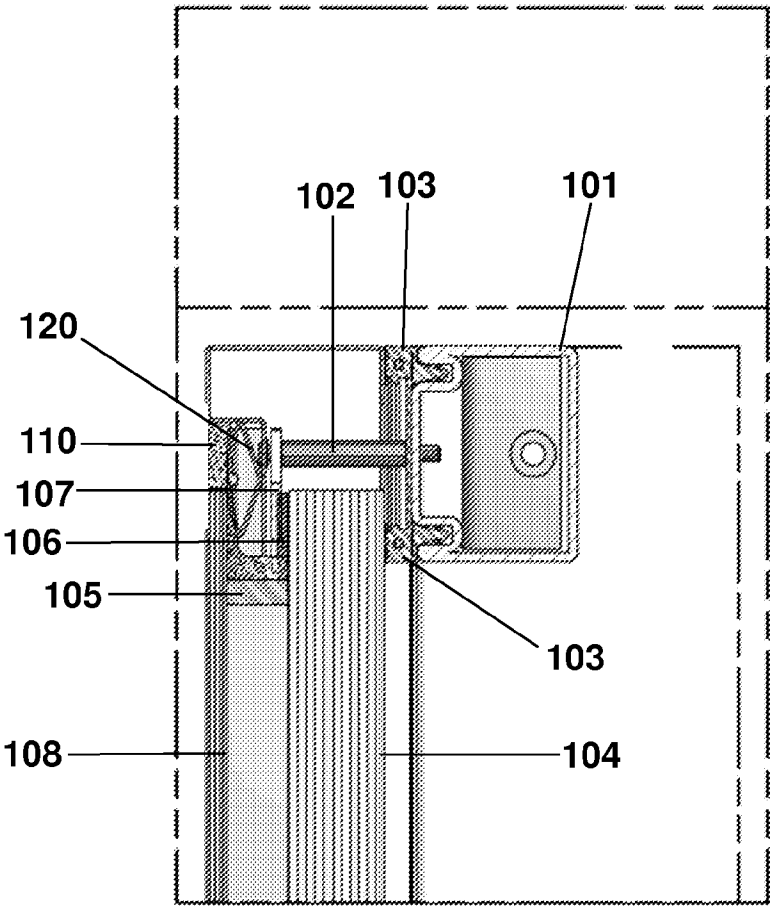
FIG. 6A is a cross-sectional view of the structurally glazed curtain wall taken along line 6A-6A in FIG. 5.
Figure 6C:
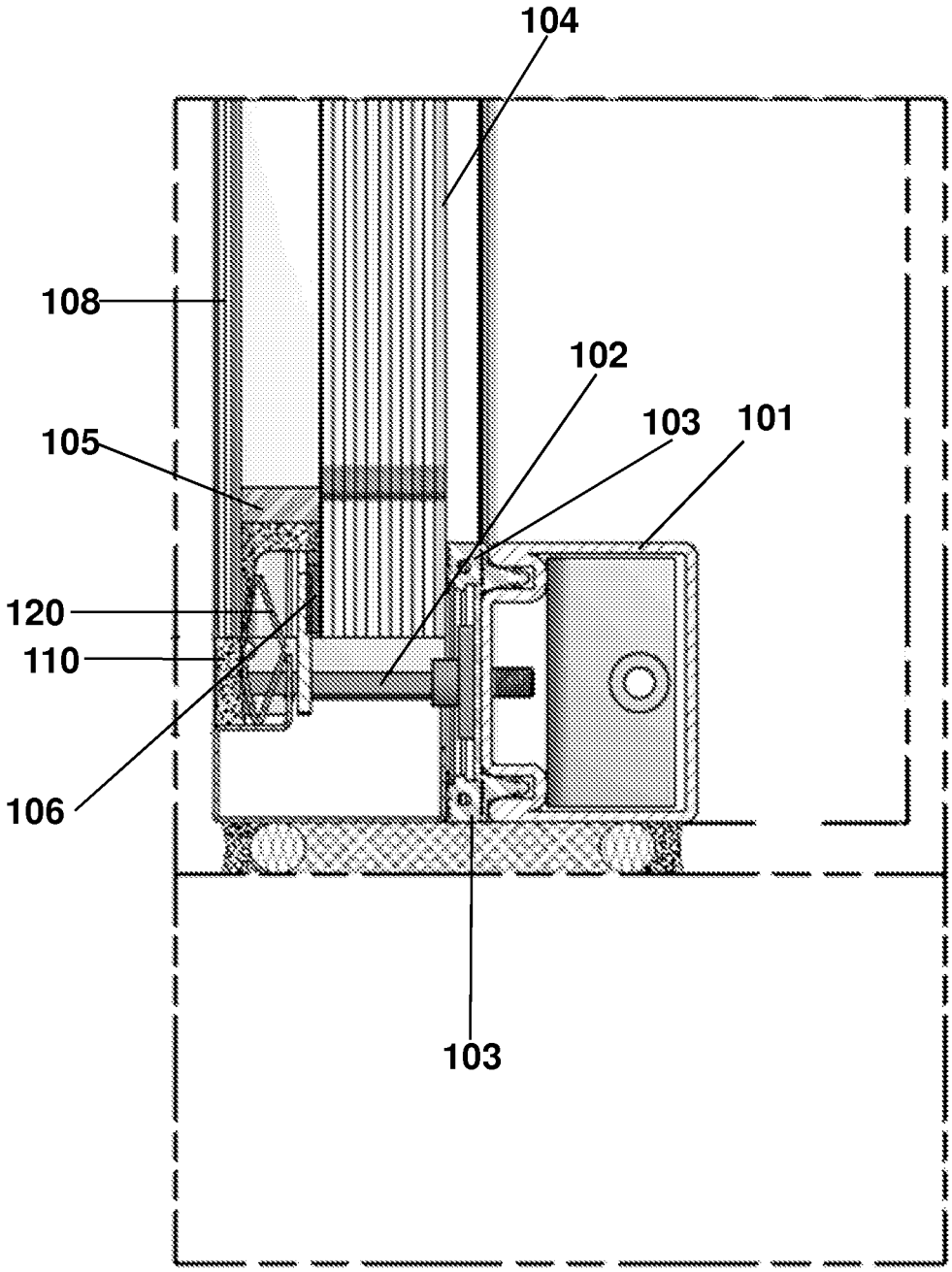
FIG. 6C is a cross-sectional view of the structurally glazed curtain wall taken along line 6C-6C in FIG. 5.
Figure 6D:
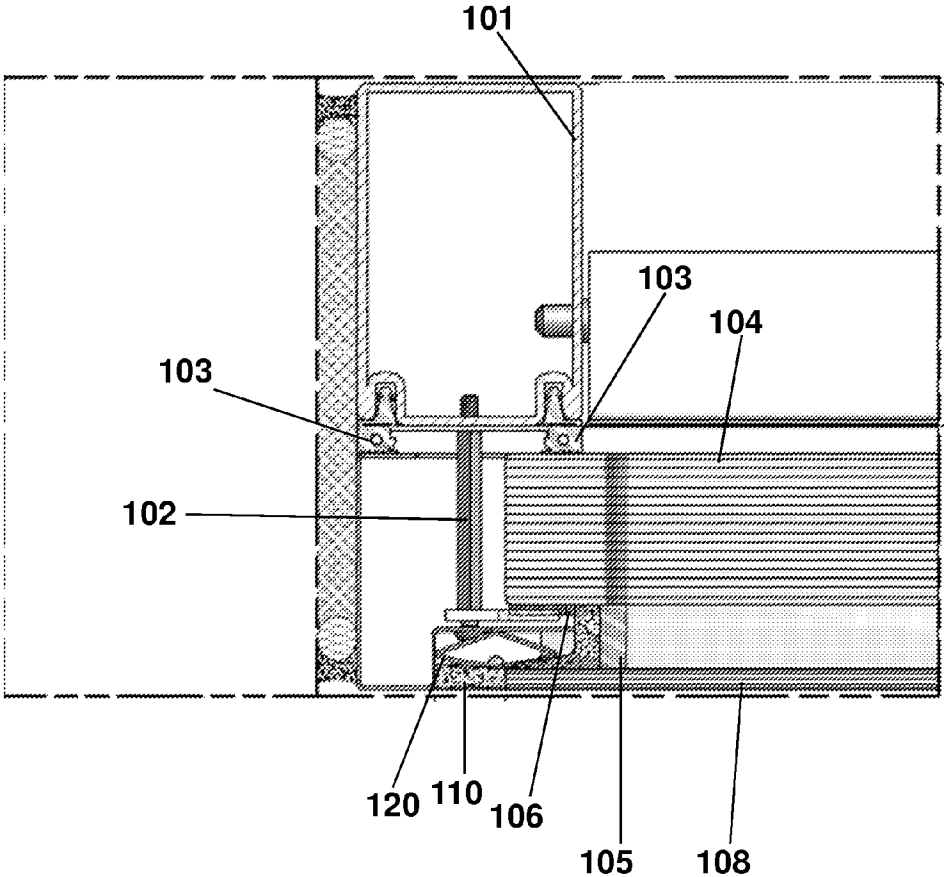
FIG. 6D is a cross-sectional view of the structurally glazed curtain wall taken along line 6D-6D in FIG. 5.
Figure 6E:
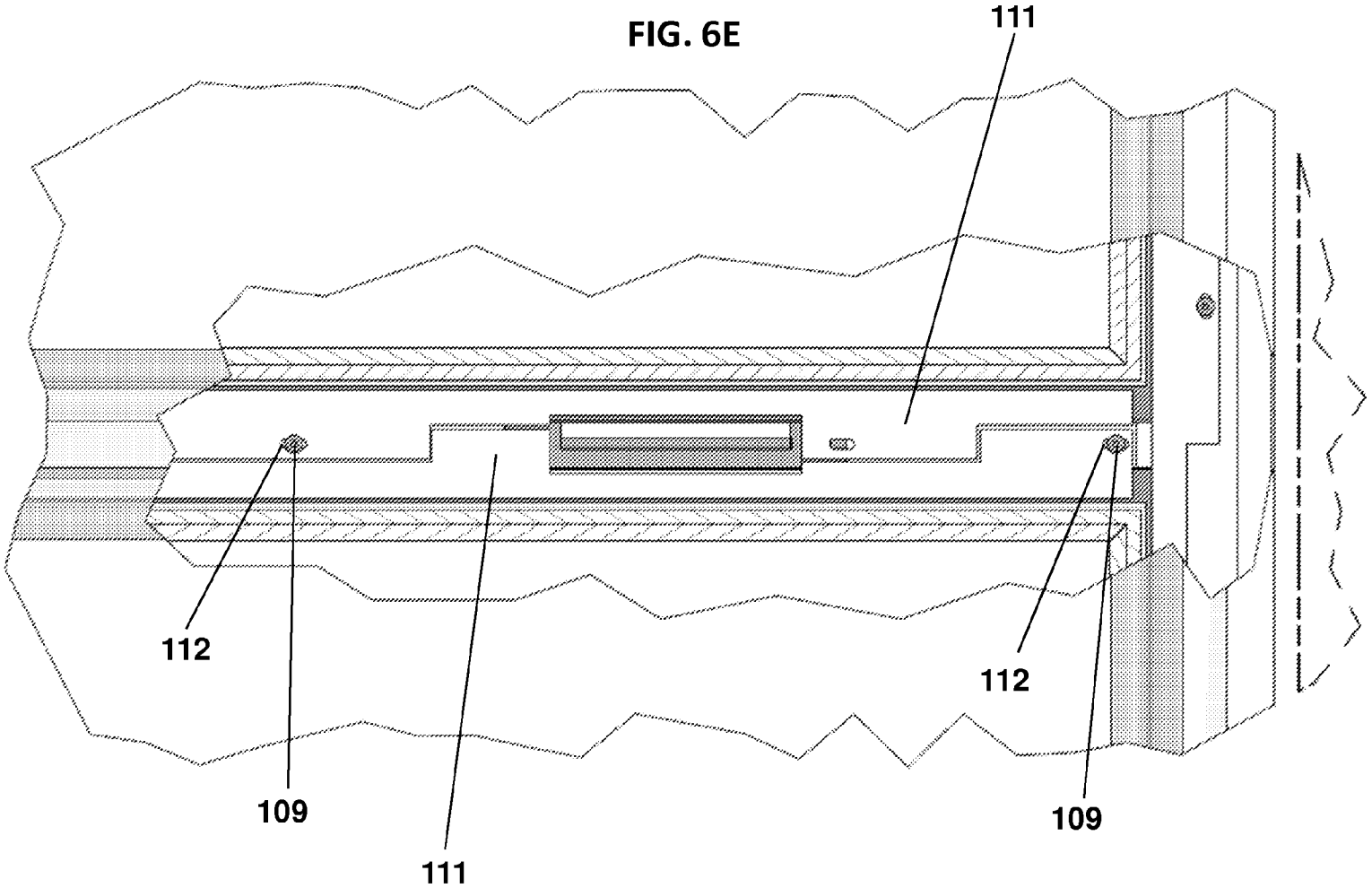
FIG. 6E is a partial cut-away view of the structurally glazed curtain wall taken along line 6E-6E in FIG. 5.

FIG. 6E illustrates a view similar to that shown in FIG. 2, illustrating interleaving metal plates 111 with openings 112 for receiving fasteners 109.

FIGS. 7 and 8A-8E illustrate another embodiment of a structurally glazed system. The structurally glazed system of FIGS. 7 and 8A-8E are similar to those shown in FIGS. 5 and 7A-7E with the differences between those two embodiments discussed below.

Figure 7:
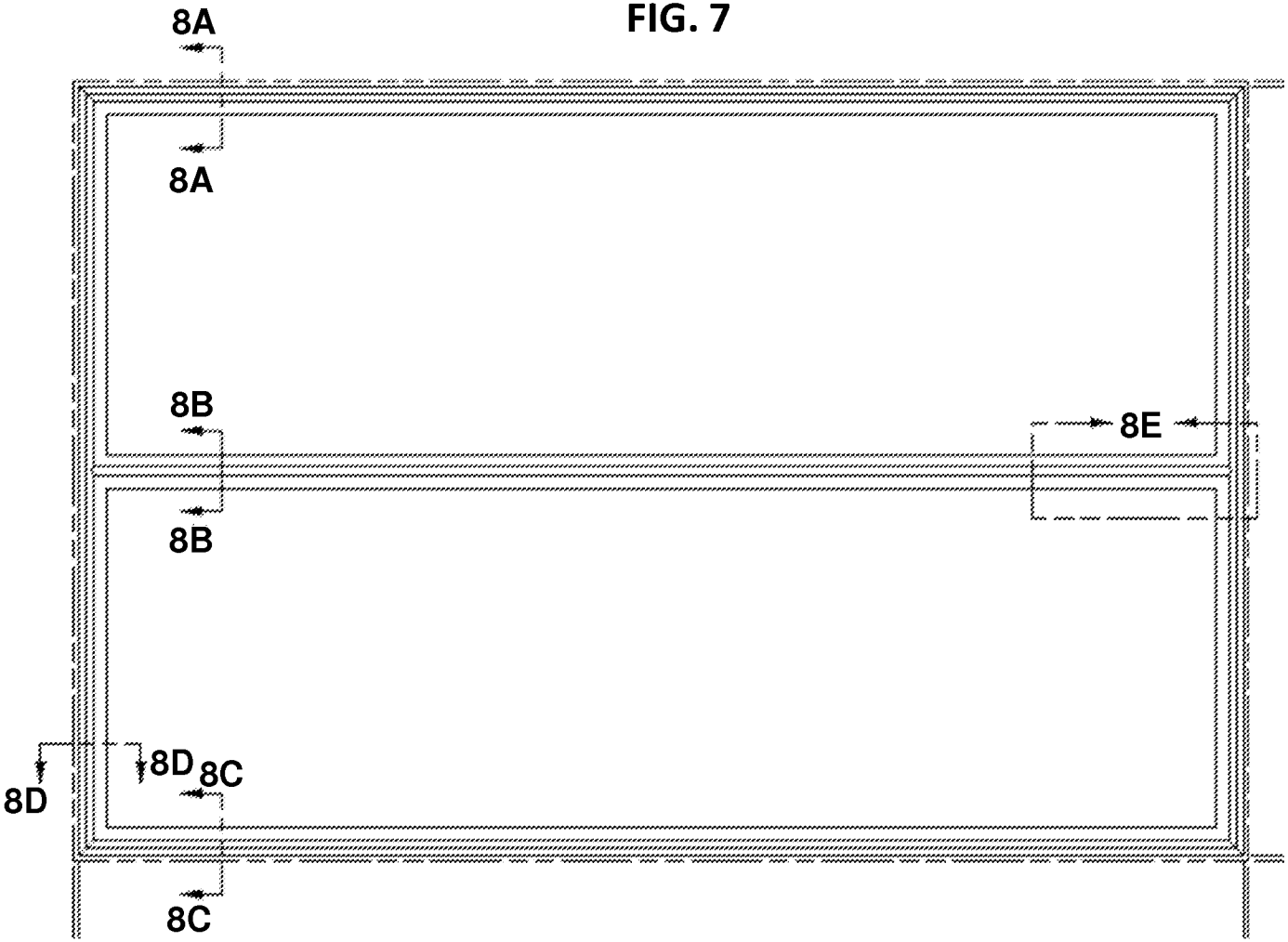
FIG. 7 is a front view of a system for constructing a structurally glazed curtain wall with an internally concealed connection to a building member, such as a steel mullion.

FIG. 7 illustrates a schematic front view of a structurally glazed system and FIGS. 8A-8E illustrate various cross-sectional and partial cross-sectional views taken from points along the structurally glazed system shown in FIG. 7.

The IGU illustrated in FIGS. 7 and 8A-8E comprises a fire rated glazing 204, a pair of glass elements 222, 224, a plurality of spacers 226, 228 extending between the glazing 204 and glass 222, and the glass 224 and 224, respectively. Thus, air can be trapped both between the fire rated glazing 204 and glass 222 and between glass 222 and glass 224.

Figure 8B:
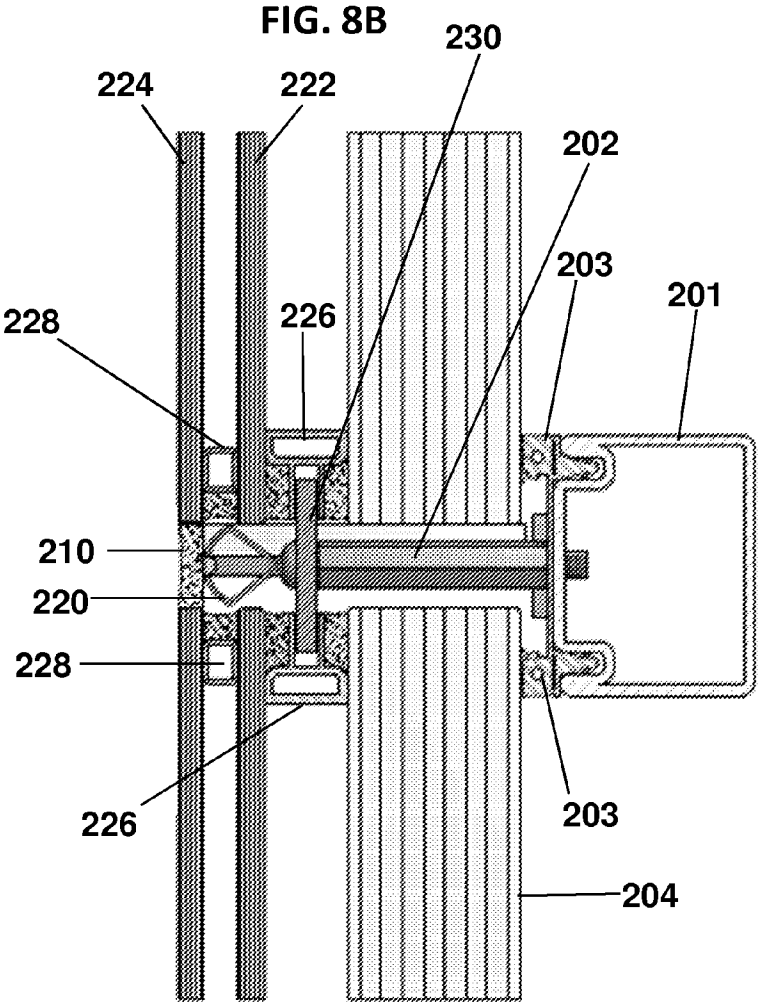
FIG. 8B is a cross-sectional view of the structurally glazed curtain wall taken along line 8B-8B in FIG. 7.
Figure 8A:
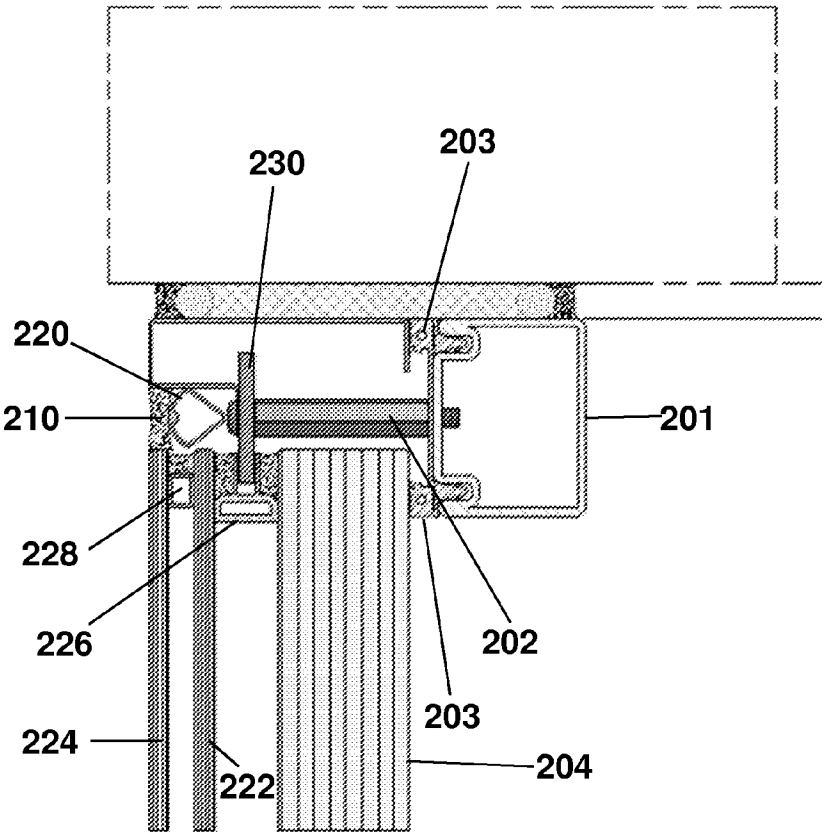
FIG. 8A is a cross-sectional view of the structurally glazed curtain wall taken along line 8A-8A in FIG. 7.
Figure 8C:
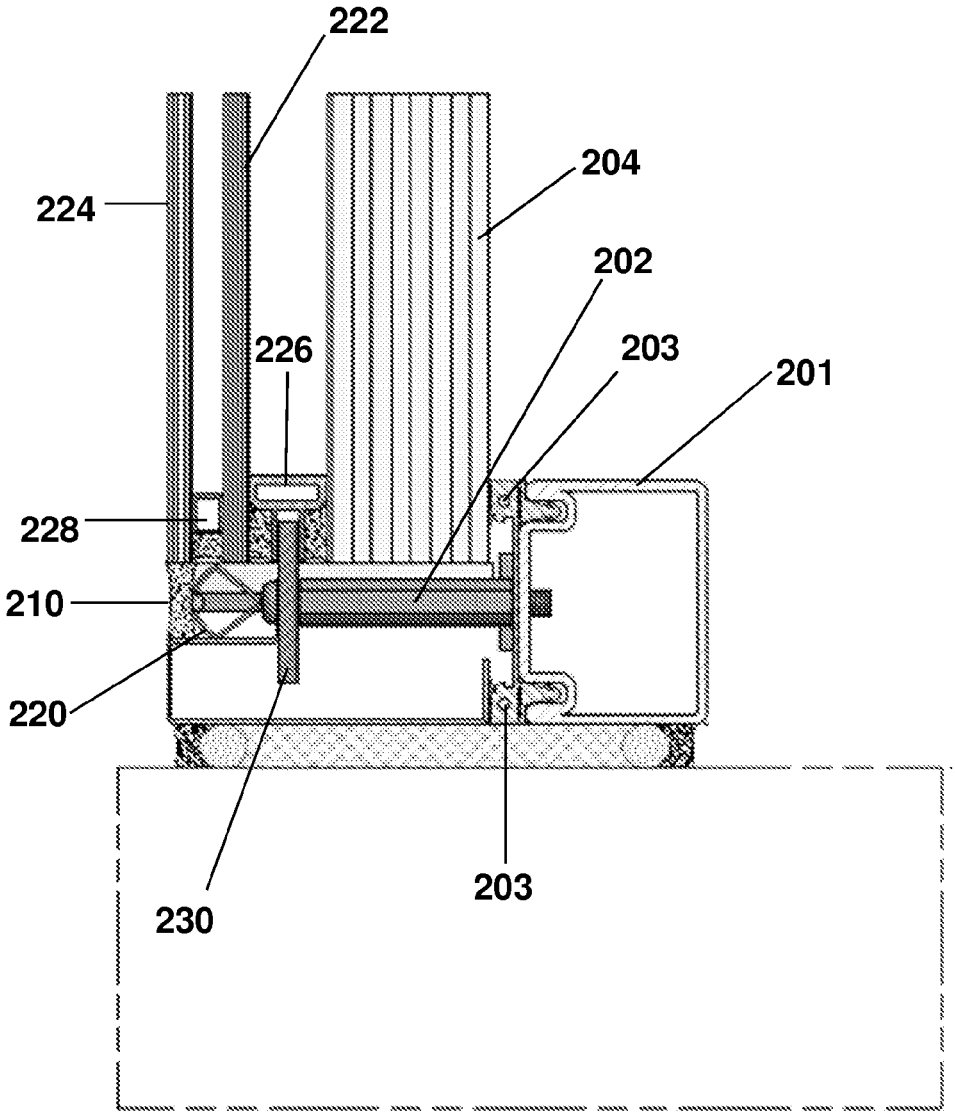
FIG. 8C is a cross-sectional view of the structurally glazed curtain wall taken along line 8C-8C in FIG. 7.
Figure 8D:
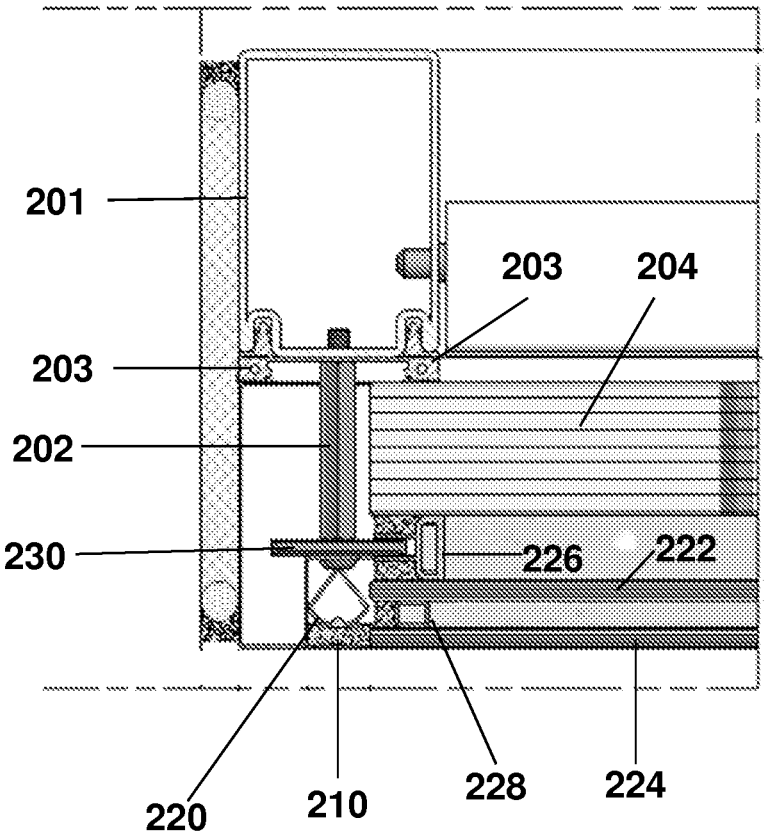
FIG. 8D is a cross-sectional view of the structurally glazed curtain wall taken along line 8D-8D in FIG. 7.

Instead of the interleaved metal plates, the pressure plates that secure the IGU to the building can comprise a plurality of toggle retainers 230. Toggle retainers 230 can be on one end of the threaded spacers 202 and can be rotated into a groove or slot for securing glazing 204 to the mullion frame member 201. The grooves or slots can be positioned adjacent an outer face of glazing 204. As shown in FIG. 8B, for example, spacers 226 can be formed with slots into which the toggle retainer can be received in order to secure glazing 204 to the building structure. The threaded spacer 202 can be tightened relative to the mullion frame member 201 using a fastener, thereby causing the plurality of toggle retainers to fully secure the glazing 204 to the mullion frame member 201.

Figure 8E:
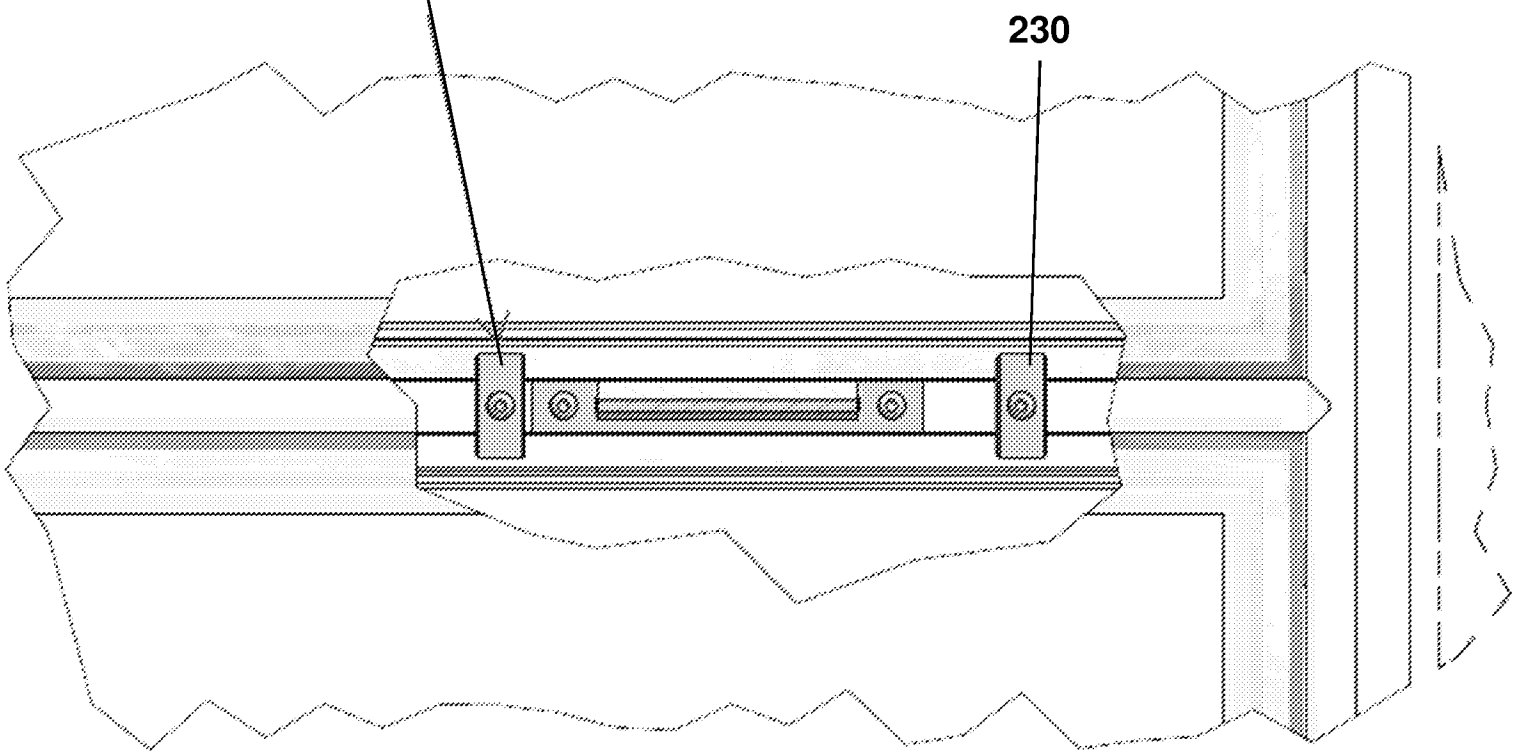
FIG. 8E is a partial cut-away view of the structurally glazed curtain wall taken along line 8E-8E in FIG. 7.

FIG. 8E illustrates a partial cut-out view of a toggle retainers that are positioned along the length of the glazing 204 to secure the glazing to the mullion frame member. In one embodiment, a plurality of toggle retainers can be provided along the length of the glazing 204. The toggle retainers and their respective slots can be spaced apart from one another to achieve a desired amount of securing of the glazing to the mullion frame member. In some embodiments, the toggle retainers are spaced apart between about 6-12 inches along the length of the glazing 204.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A structurally glazed curtain wall system comprising:

a first insulated glazing unit comprising a fire rated glazing unit spaced apart and coupled to a glass unit;

a first pressure plate including a plurality of extending members, the first pressure plate configured to be coupled to a building structure and positionable between an outer face of the fire rated glazing unit and an inner face of the glass unit;

a second insulated glazing unit and a second pressure plate coupling the second insulated glazing unit to the building structure, the second pressure plate including a plurality of extending members; and a plurality of retaining members configured to secure the first and second pressure plates to the building structure;

wherein the extending members of the first and second pressure plates have openings for receiving the retaining members, and the first and second pressure plates are at least partially interleaved such that the extending members vertically overlap one another.

2. The structurally glazed curtain wall system of claim 1, further comprising a plurality of threaded stand-off spacers the threaded stand-off spacers being positioned between the extending members of the first and second pressure plates and the building structure and configured to receive at least one of the retaining members to couple the first and second pressure plates to the building structure.

3. The structurally glazed curtain wall system of claim 1, wherein the fire rated glazing unit and glass unit of the first insulated glazing unit are coupled together by at least one spacer, and a first face of the spacer is adhered to an outside surface of the fire rated glazing unit and a second face of the spacer is adhered to an inside surface of the glass unit.

4. The structurally glazed curtain wall system of claim 1, wherein the building structure comprises at least one steel mullion and the first and second glazing units are coupled to the steel mullion by the extending members of the first and second pressure plates.

5. The structurally glazed curtain wall system of claim 1, further comprising a plurality of glazing gaskets positioned between the first and second pressure plates and the outside surfaces of the fire rated glazing of the first and second insulated glazing units.

6. The structurally glazed curtain wall system of claim 5, further comprising a silicone weather seal positioned between the first insulated glazing unit and the second insulated glazing unit.

7. The structurally glazed curtain wall system of claim 1, wherein the insulated glazing unit meets fire barrier and thermal transfer limitations of ASTM E119-10a for a period duration of at least 45 minutes.

8. A method of constructing a structurally glazed curtain wall, the method comprising:

providing first and second insulated glazing units comprising respective first and second fire rated glazing units coupled to respective first and second glass units, the first and second fire rated glazing units being coupled to the respective first and second glass units with a plurality of spacers;

positioning a first pressure plate at least partially between the first fire rated glazing unit and the first glass unit, the first pressure plate comprising extending members;

positioning a second pressure plate at least partially between the second fire rated glazing unit and the second glass unit, the second pressure plate comprising extending members;

aligning the first and second insulated glazing units such that the first and second pressure plates are at least partially interleaved and the respective extending members of the first and second pressure plates vertically overlap one another; and coupling the first and second insulated glazing units to a building structure by securing a plurality of retaining members to the first and second pressure plates and the building structure, wherein the first and second pressure plates secure the first and second insulated glazing units to the building structure by applying a pressure against an outer face of the respective first and second fire rated glazing units.

9. The method of claim 8, wherein the coupling of the first and second insulated glazing units to the building structure comprises securing fasteners through the extending members of the first and second pressure plates and into threaded stand-off spacers positioned between the building structure and the first and second pressure plates.

10. The method of claim 9, wherein the first and second pressure plates comprise a plurality of rotatable retaining members and the coupling of the first and second insulated glazing units to the building structure comprises:

positioning the plurality of rotatable retaining members into slots provided adjacent the outer face of the first and second fire rated glazing units; and securing the rotatable retaining members to the building structure.

11. The method of claim 8, further comprising securing a weather seal between the first and second insulated glazing units.

12. A structurally glazed curtain wall system, comprising:

a first insulated glazing unit comprising a fire rated glazing unit spaced apart and coupled to a glass unit;

a first pressure plate configured to be coupled to a building structure and positionable between an outer face of the fire rated glazing unit and an inner face of the glass unit;

a plurality of retaining members configured to secure the first pressure plate to the building structure;

a plurality of stand-off spacer members, each threaded stand-off spacer being positioned between the first pressure plate and configured to receive at least one of the retaining members to couple the first pressure plate to the building structure;

at least one rigid spacer member positioned adjacent the outer face of the fire rated glazing unit, the at least one rigid spacer member including two spaced-apart extending portions defining a slot.

13. The structurally glazed curtain wall system of claim 12, wherein the first pressure plate comprises a rotatable retainer plate that is sized to fit within the slot to secure the fire rated glazing unit to the building structure.

14. The structurally glazed curtain wall system of claim 13, further comprising a plurality of rotatable retainer plates and a plurality of rigid spacer members defining a plurality of slots, each rotatable retainer plate comprising a toggle retainer that is sized to be received within one of the plurality of slots.

15. The structurally glazed curtain wall system of claim 12, wherein the fire rated glazing unit and the glass unit are coupled together by the at least one rigid spacer member, and a first face of the rigid spacer member is adhered to an outside surface of the fire rated glazing unit and a second face of the rigid spacer member is adhered to an inside surface of the glass unit.

16. The structurally glazed curtain wall system of claim 12, further comprising a second insulated glazing unit and a second pressure plate coupling the second insulated glazing unit to the building structure.

17. The structurally glazed curtain wall system of claim 16, wherein the building structure comprises at least one steel mullion and the first and second glazing units are coupled to the steel mullion by the first and second pressure plates.

18. The structurally glazed curtain wall system of claim 16, further comprising a silicone weather seal positioned between the first insulated glazing unit and the second insulated glazing unit, the silicone weather seal being supported by a backer support.

* * * * *